United States Patent [19]

Saito

[11] Patent Number: 4,898,540

[45] Date of Patent: Feb. 6, 1990

[54] CONNECTOR FOR A PRINTED CIRCUIT BOARD

[75] Inventor: Masaaki Saito, Tokyo, Japan

[73] Assignee: Yamaichi Electric Mfg. Co., Ltd., Tokyo, Japan

[21] Appl. No.: 291,299

[22] Filed: Dec. 28, 1988

[30] Foreign Application Priority Data

Dec. 28, 1987 [JP] Japan ..... 62-336265

[51] Int. Cl.[4] ..... H01R 13/62

[52] U.S. Cl. ..... 439/153; 439/160; 439/326; 439/328; 439/341

[58] Field of Search ..... 439/152–159, 439/377, 325–328, 338, 341, 372, 59–62, 64, 629–637

[56] References Cited

U.S. PATENT DOCUMENTS

| | | | |
|---|---|---|---|
| 3,150,906 | 9/1964 | Chambon et al. | 439/157 |
| 4,017,138 | 4/1977 | Evans | 439/328 |
| 4,136,917 | 1/1979 | Then et al. . | |
| 4,241,966 | 12/1988 | Gomez | 439/157 |
| 4,318,579 | 3/1982 | Tudberry | 439/325 |
| 4,640,565 | 2/1987 | Hasircoglu | 439/155 |

*Primary Examiner*—David Pirlot

*Attorney, Agent, or Firm*—Wenderoth, Lind & Ponack

[57] ABSTRACT

A connector for a printed circuit board has a printed circuit board having a cut-out portion at one corner of its inserting end side and a plurality of contact points or conductor strips juxtaposed along a marginal portion of its inserting end and a connector body having a groove through which the printed circuit board is inserted and withdrawn. The groove is provided therein with a plurality of contacts which are arranged in such a manner as to be resiliently contacted with a group of the contact points. The connector body is provided with a single push-up lever for pushing up one side of the printed circuit board. The single push-up lever is pivotally supported on one end portion of the connector body. The push-up lever is provided with a push-up portion adapted to engage with the cut-out portion of the printed circuit board. The cut-out portion is given a push-up force by the push-up portion resulting from pivotal movement of the push-up lever. The printed circuit board is pushed up at one end side thereof in a cantilever fashion when it is withdrawn.

1 Claim, 3 Drawing Sheets

CONNECTOR FOR A PRINTED CIRCUIT BOARD

BACKGROUND OF THE INVENTION

1. Field of the Invention

This invention relates to a connector for a printed circuit board, and particularly to a connector in which a printed circuit board having a group of contact points juxtaposed along the marginal portion of the inserting end thereof is inserted into an insertion groove of a contact body so as to make a resilient contact withe the contacts and especially, the printed circuit board can be smoothly and easily released or separated from a group of the contacts which firmly catch the marginal portion of the end of the printed circuit board.

2. Brief Description of the Prior Art

In a conventional connector for a printed circuit board as disclosed, for example, in U.S. Pat. No. 4,136,917, to then et al., a printed circuit board is inserted at an angle (in its backwardly inclined posture) into a connector body and is then erected in its upright posture against the elasticity of the contacts to obtain a contact pressure. In order to withdraw the printed circuit board from the connector body, the printed circuit board held in its upright posture must be inclined backwardly once again and therefore, the printed circuit board, while maintaining the foregoing posture, must be released or separated the contact points from the connector body. Therefore, a printed circuit board, when inserting into or withdrawing from a connector body, it often interfered with an adjacent printed circuit board which is already inserted in the connector body and is therefore difficult to make a smooth insertion or withdrawal. The awkward operation of insertion of withdrawal sometimes damages parts mounted on the printed circuit board.

There is also known a conventional connector for a printed circuit board in which a printed circuit board can be inserted into or withdrawn from a connector body in its upright posture. This conventional connector, however, has the disadvantage in that a large amount of force is required for the inserting and withdrawing operations. Moreover, since this is designed such that a pair of retaining nails formed on a connector body are resiliently engaged in a pair of retaining holes formed in both ends of the printed circuit board so as to maintain the connection, a large amount of force, especially when the printed circuit board is withdrawn from the connector body, is required and a jig must be used for releasing the catch of the retaining nails when the printed circuit board is withdrawn.

The present inventin has been accomplished in order to overcome the above-mentioned problems inherent in the prior art.

SUMMARY OF THE INVENTION

It is therefore an object of the present invention to provide a connector for a printed circuit board in which a connector body is provided with a single push-up lever for pushing up one side of a printed circuit board, and one end portion of the printed circuit board is pushed up by means of the operation of the push-up lever in a cantilever fashion so that the most of contact points juxtaposed along the insertion edge of the printed circuit board are released from a group of contacts so as to facilitate the removal of the printed circuit board.

A specific object of the present invention is to provide a connector for a printed circuit board in which a printed circuit board, when inserting into or withdrawing from a connector, is not interfered with an adjacent printed circuit board already inserted and therefore, parts mounted on the printed circuit board are not damaged during the inserting or withdrawing operation.

Another specific object of the present invention is to provide a connector for a printed circuit board in which no jig is required for withdrawing a printed circuit board from a connector.

In order to achieve the above objects, there is essentially provided a connector for a printed circuit board comprising a printed circuit board having a cut-out portion at one corner of its inserting end side and a plurality of contact points or conductor strips juxtaposed along a marginal portion of its inserting end, and a connector body having a groove through which said printed circuit board is inserted and withdrawn, said groove being provided therein with a plurality of contacts which are arranged in such a manner as to be resiliently contacted with a group of said contact points. The connector body is provided with a single push-up lever for pushing up one side of said printed circuit board. The single push-up lever being pivotally supported on one end portion of the connector body. The push-up lever is provided with a push-up portion adapted to engage with said cut-out portion of said printed circuit board. The cut-out portion is given a push-up force by said push-up portion according to pivotal movement of said push-up lever. The printed circuit board is pushed up at one end side thereof in a canatilever fashion when it is withdrawn.

When the single push-up lever provided to one end portion of the connector body is swung, the push-up portion of the lever is brought into engagement with a cut-out portion of the printed circuit board, thereby to push up the one end portion of the printed circuit board in a cantilever fashion. As a result, the printed circuit board is raised or floated at one side, and the contact points and the contacts are completely brought out of contact from one side of the printed circuit board where the push-up force is applied to a middle part thereof, whereas the contact points and the contacts are brought into a half-way engaging state from the middle part to the other end side of the printed circuit board. As a result, the withdrawing load of the printed circuit board is greatly reduced to facilitate an easy withdrawal.

BRIEF DESCRIPTION OF THE DRAWINGS

Additional objects and advantages of the present invention will be more readily apparent from the following detailed description of a preferred embodiment thereof when taken together with the accompanying drawings in which.

The accompanying drawings illustrate one embodiment of the present invention in which.

DETAILED DESCRIPTION OF THE EMBODIMENT

One preferred embodiment of the present invention will be described hereinafter with reference to the accompanying drawings.

Figure 1:
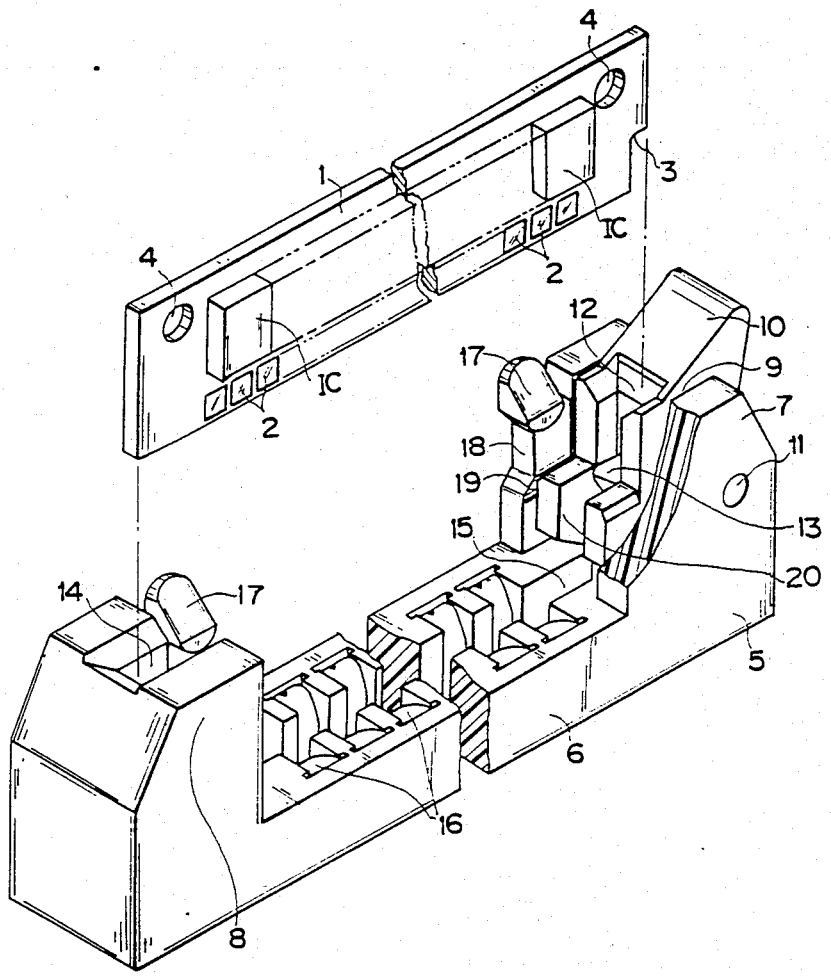
FIG. 1 is a perspective view of a printed circuit board and a connector body, the former being already withdrawn from the latter.

FIG. 1 is a perspective view of a printed circuit board already withdrawn from a connector body. In the figure, 1 denotes a printed circuit board. The printed circuit board 1 is provided with a group of contact pints 2 linearly arranged on the outer surface of a marginal portion at the inserting side with respect to a connector body along the marginal portion. One corner of the marginal portion where the group of contact points 2 are arranged is formed with a cutout portion 3 for discriminating the polarity or showing the inserting posture of the printed circuit board 1. Two corners of the opposite marginal portions (where the group of contact points 2 are not disposed) are each formed with a retaining hole 4 for determining the inserting position of the printed circuit board 1 with respect to the connector body. Such formed printed circuit board 1 is mounted on the outer surface thereof with electric parts such as ICs (integrated circuits), and the like.

5 denotes a connector body into which or from which the printed circuit board 1 is inserted.or withdrawn. The connector body 5 comprises a base 6 and raised poritons 7, 8 projected from both ends thereof. One raised portion 7 is formed with a mounting groove 9 between a pair of opposite walls. The mounting groove 9 has disposed therein a single push-up lever 10 for pushing up one side of the printed circuit board. The push-up lever 10 is pivotally supported on a shaft 11. The push-up lever 10 is formed at is inner side with a groove 12 for guiding one marginal portion of the printed circuit board 1. The guide groove 12 is provided with a push-up portion 13 projecting from its bottom portion and engaging with the cut-out portion 3 of the printed circuit board 1.

14 denotes a groove for guiding the other marginal portion of the printed circuit board 1 formed in the inner side of the raised portion 8, and 15 denotes an insertion groove for receiving the marginal portion of the inserting end of the printed circuit board 11 formed in the base 6. Both ends of the insertion groove 15 are communicated with the guide grooves 12 and 14 formed in the lever 10 and the raised portin 8. 16 denotes a group of contacts buried in the base 6 and linearly arranged in the insertion groove 15.

17 denotes retaining protrusions for engaging in the retaining holes 4 formed in the printed circuit board 1. The retaining protrusions 17 are formed on the upper ends of lock members 18 raised in the vicinity of one side surfaces of the raised portions 7 and 8. Each lock member 18 is provided on a generally intermediate portion of its front surface with an inclined surface 19 which is inclined forwardly as it extends upward. 20 denotes a lock releasing projection defined on both sides of the push-up portion of the push-up lever 10 and serving also as a wall for defining the guide groove. The projection 20 is normally abutted against the inclined surface 19. 21 denotes a stopper member projecting from the bottom portion of the push-up lever 10. 22 denotes a step portion formed on the bottom portion of the groove in which the push-up lever 10 is disposed. When the stopper member 21 reaches the step portion 22, the pivotal movement of the push-up lever 10 in the push-up direction is restricted in amount.

The retaining protrusions may be omitted or only one retaining protrusion need be provided.

The printed circuit board 1 is inserted at its both side edges into the guide grooves 12 and 14 formed in the push-up lever 10 and in the raised portion 8 and guided by the grooves 12 and 14. Upon insertion, the printed circuit board 1 pushes away the retaining protrusions 17 out of the inserting orbit by its outer surface and is further inserted into the insertion groove 15 of the base 6. As a result, the group of contact points 2 are brought into contact with the group of corresponding contacts 16. Immediately before the printed circuit board 1 reaches the terminal position of its inserting movement, the retaining protrusion 17 is resiliently engaged in the retaining hole 4 and the inserting edge of the printed circuit board 1 abuts against the bottom surface of the insertion groove 15.

In the foregoing insertion state (see FIGS. 2A and 3A), the retaining hole 4 and the retaining protrusion 17 are loosely engaged having a play in the withdrawing direction.

When the printed circuit board 1 is to be inserted into the guide grooves 12 and 14 of the connector body 5, while only one retaining protrusion 17 is being pushed away by the outer surface of the printed circuit board 1 out of the inserting orbit as previously described, the other retaining protrusion 17 may be pushed away out of the inserting orbit of the printed circuit board 1 beforehand by operating the push-up lever 10.

Figure 2A:
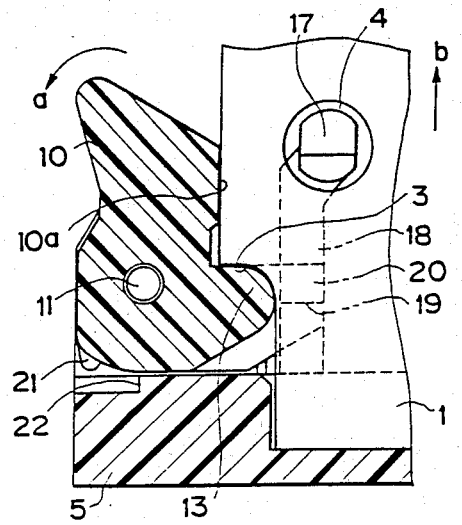
FIGS. 2A, 2B and 2C and FIGS. 3A, 3B and 3C are schematic views for explaining the process for withdrawing the printed circuit board from the connector body.
Figure 3A:
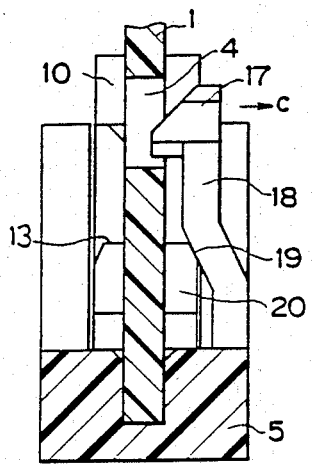

In the state where the printed circuit board 1 is inserted as described, the push-up portion 13 and the cut-out portion 3, as shown in FIGS. 2A and 3A, contact each other, and the projection 20 and the inclined surface 19 contact each other so that the printed circuit body 1 is ready for removal. At this time, the inner surface 10*a* of the guide groove 12 of the push-up lever 10 and the side end surface of the printed circuit board 1 abut against each other.

Figure 2B:
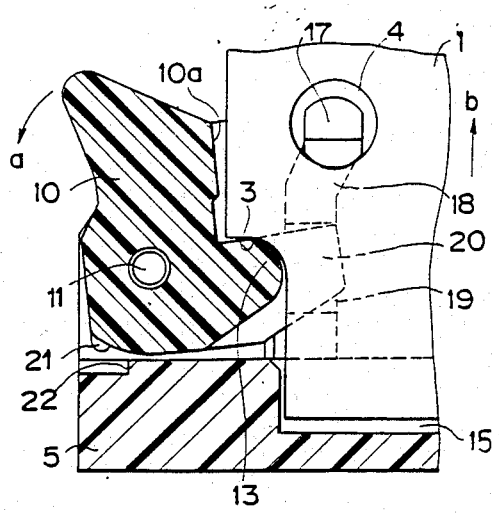
Figure 3B:
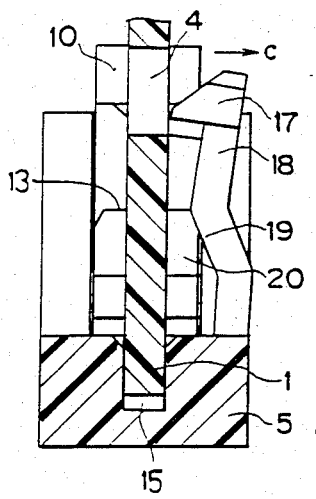

Next, in order to withdraw the printed circuit board 1 from the connector body 5, the push-up lever 10, as shown in FIGS. 2B and 3B, are pivote outward about the shaft 11 in the direction as shown by an arrow a so that the push-up portion 13 pushes up the cut-out portion 3. That is, the printed circuit board 1, which is held by the push-up portion 13 ina cantilever fashion, is pushed upward in the direction as shown by an arrow b. During the pushing-up process, the projection 20 urges the inclined surface 19 outward to move one retaining protrusion 17 in the direction as shown by an arrow c so as to bring it out of engagement from the retaining hole 4.

Figure 2C:
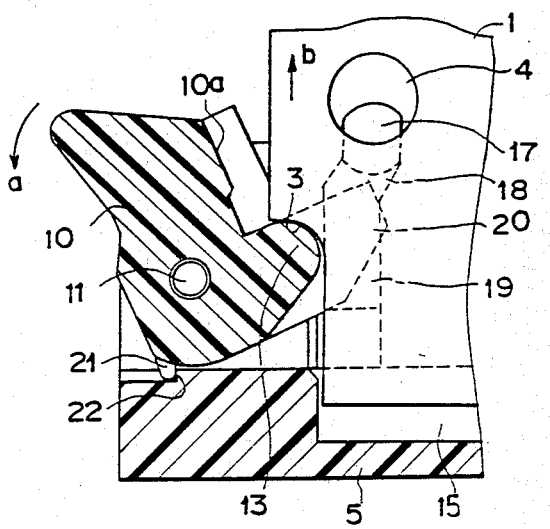
Figure 3C:
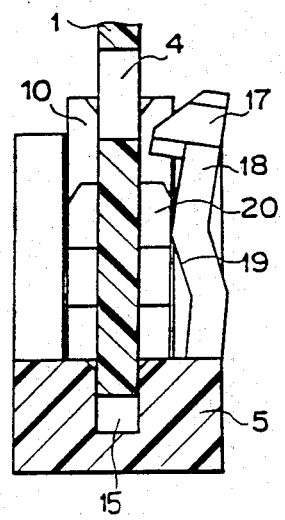
Figure 4:
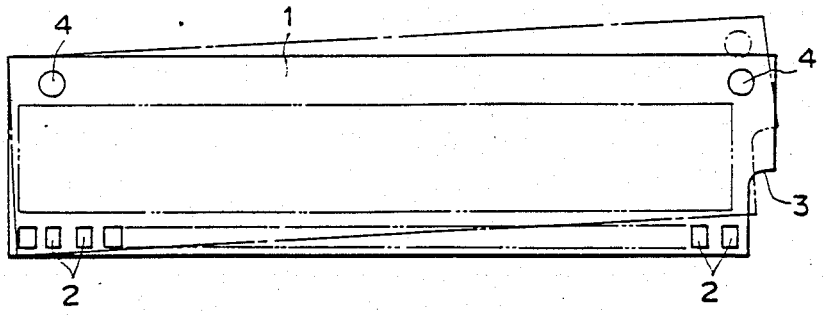
FIG. 4 is a schematic view showing the inclined state of the printed circuit board when the board is pushed up in a cantilever fashion.

Successively, if the push-up lever 10 is pivoted outward as shown in FIGS. 2C and 3C, the printed circuit board 1 is further pushed up in a cantilever fashion. As a result, the printed circuit board 1, as shown in FIG. 4, is finally pivoted at one end thereof by using the other end as a fulcrum to obtain an inclined posture.

Due to this inclined posture, the group of contact points 2 and the contacts 16 are completely brought out of engagement from the push-up end to a middle part of the printed circuit board 1, while they are brought into a halfway disengaged state from the middle part to the fulcrum side so as to be ready for removal.

The push-up lever 10, as shown in FIG. 2C, is kept from pivoting any further due to the abutment of the stopper member 21 against the step portion 22 formed on the connector body 5 and thus, a predetermined amount of push-up is ensured.

When the printed circuit board 1 has been removed, the retaining protrusions 17 are released from the pressure. As a result, the lock manner 18 is restored and the push-up lever 10 is caused to pivot inward by the restoring force of the lock member 18 so as to be ready for being pushed up. At the same time, the lock members 18 and the retaining protrusions 17 themselves are also restored to the respective states before insertion of the printed circuit board 1.

As described in the foregoing, by handling a single push-up lever disposed on a connector body, the printed circuit board is pushed up in a cantilever fashion so that a group of contact points from the push-up end, i.e., one end of the printed circuit board to a middle part thereof are brought to be completely out of engagement from a group of contacts and a group of contact points from the middle part to the other end of the printed circuit board are brought into a half-way disengaged state from a group of contacts. As a result, the withdrawing load is greatly reduced and therefore the printed circuit board can easily be withdrawn by the other single hand. Furthermore, since the printed circuit board is pushed up at its one side by a single push-up lever to facilitate easy removal, the installation space of the connector body and the operating space of the lever are minimized and connectors can be arranged in high density.

Furthermore, since the printed circuit board is pushed up by using a cut-out formed in one side of the printed circuit board, the number of polarity of contact points can be made of high density without occupying a large outer surface space of the printed circuit board. Moreover, electric parts mounted on the printed circuit board are not interfered with by electric parts mounted on an adjacent printed circuit board during the inserting or withdrawing operation. Therefore, the inserting or withdrawing operation is not adversely affected are the electric parts damaged by interference any more. Therefore, the inserting and withdrawing operation can be performed safely and simply.

Having now fully set forth a preferred embodiment of the concept underlying the present invention, various other applications and embodiments as well as certain modifications of the embodiment herein shown and described will obviously occur to those skilled in the art upon becoming familiar with the underlying concept. It is to be understood, therefore, that within the scope of the appended claim, the present invention may be practiced otherwise than as specifically set forth herein.

What is claimed is:

1. A connector for a printed circuit board of the type having an inserting end, first and second corners at opposite sides of the inserting end, a cut-out portion at a first one of the first and second corners of the inserting end, a retaining hole at each of the first and second corners, and a plurality of contact points or conductor strips juxtaposed along a marginal portion of the inserting end, said connector comprising:

a connector body having first and second end portions, said connector body having a groove through which a printed circuit board is inserted and withdrawn;

a plurality of contacts disposed in said groove, said plurality of contacts being arranged for resiliently contacting a plurality of contact points or conductor strips on a printed circuit board received in said groove;

a resilient locking member attached to said connector body, said resilient locking member releasably engaging a first retaining hole at a first corner portion at the inserting end of a printed circut board when a printed circuit board is received in said groove in said connector body;

a single push-up lever pivotably attached to said connector body at said first end portion thereof, means on said single push-up lever for pushing up only one corner of a printed circuit board received in said groove in said connector body when said single push-up lever is pivoted, said means for pushing up only one corner of a printed circuit board including a push-up portion defined on said single push-up lever for engaging a cut-out portion at the first one of the first and second corners of the inserting end of a printed circuit board, and said single push-up lever further including disengaging means for simultaneously disengaging said locking member from a first retaining hole of a printed circuit board as said means for pushing up only one corner of a printed circuit board pushes up the one corner of the printed circuit board when said singel push-up lever is pivoted for releasing a printed circuit board received in said groove in said connector body; and wherein, when said push-up lever is pivoted for releasing a printed circuit board, the printed circuit board is pivoted about the second corner thereof by the pushing up of only one corner of the printed circuit board by the single push-up lever.

* * * * *